US010661431B1

(12) United States Patent
Hightower

(10) Patent No.: US 10,661,431 B1
(45) Date of Patent: May 26, 2020

(54) ADJUSTABLE MECHANIC CREEPER

(71) Applicant: Aaron James Hightower, Grand Junction, CO (US)

(72) Inventor: Aaron James Hightower, Grand Junction, CO (US)

( * ) Notice: Subject to any disclaimer, the term of this patent is extended or adjusted under 35 U.S.C. 154(b) by 0 days.

(21) Appl. No.: 16/296,975

(22) Filed: Mar. 8, 2019

(51) Int. Cl.
*B25H 5/00* (2006.01)

(52) U.S. Cl.
CPC ..... *B25H 5/00* (2013.01)

(58) Field of Classification Search
CPC ..... B25H 5/00
See application file for complete search history.

(56) References Cited

U.S. PATENT DOCUMENTS 1,327,103 A * 1/1920 Knowles ..... B25H 5/00 280/32.6
4,530,419 A * 7/1985 Rumage ..... B25H 5/00 182/106
4,895,380 A 1/1990 Brooks et al.
5,072,955 A * 12/1991 Holland ..... B25H 1/16 182/116
5,460,392 A * 10/1995 Hansen ..... B25H 5/00 280/32.5
6,042,128 A 3/2000 Dinkins
6,095,532 A 8/2000 Martin
6,199,877 B1 3/2001 Shockley
6,425,590 B1 7/2002 Whiteside et al.
6,578,857 B1 6/2003 Whiteside et al.
6,595,590 B2 * 7/2003 Bottoms ..... A47C 9/025 135/66
6,824,149 B1 * 11/2004 Whitlock ..... B25H 5/00 280/32.6
7,025,421 B1 4/2006 Fowler et al.
7,070,189 B2 7/2006 Grauss
7,374,181 B1 5/2008 Wu
8,777,237 B2 7/2014 Brittingham et al.
9,379,528 B2 * 6/2016 Shaw ..... H02G 3/0456
9,623,551 B1 * 4/2017 Bowen ..... A47C 1/00
2004/0178589 A1 * 9/2004 Grauss ..... B25H 5/00 280/32.6
2005/0199768 A1 9/2005 Tam et al.
2005/0204967 A1 * 9/2005 Wrinkle ..... B25H 5/00 108/146
2007/0187184 A1 8/2007 Nasuti et al.
2007/0235960 A1 10/2007 Pantaleoni
2012/0235371 A1 9/2012 Smith
2014/0169922 A1 6/2014 Cozza et al.
2016/0039088 A1 2/2016 Blasjo
2018/0222037 A1 * 8/2018 Hendrickson ..... B25H 5/00
2018/0319007 A1 * 11/2018 Wilkinson ..... B66F 11/04

* cited by examiner

*Primary Examiner* — Brian L Swenson
(74) *Attorney, Agent, or Firm* — Dunlap Bennett & Ludwig PLLC

(57) ABSTRACT

An adjustable mechanic creeper includes a base having an upper surface, a lower surface, and a plurality of casters coupled to the lower surface. A height adjustment brace is coupled to the upper surface of the base. A table includes an upper surface, a lower surface, a front end, a rear end, and sides. The table is coupled to the height adjustment brace. The height adjustment brace is configured to raise and lower the table relative to the base. A seat includes a main frame and at least one cushion coupled to the main frame. The seat is slidably coupled to the upper surface of the table by a track extending from the front end of the table to the rear end of the table.

10 Claims, 5 Drawing Sheets

ADJUSTABLE MECHANIC CREEPER

BACKGROUND OF THE INVENTION

The present invention relates to mechanic creepers and, more particularly, to an adjustable mechanic creeper.

Airplane mechanics, automated machinery assemblers, etc., sometimes use various stools and flat dollies to support themselves while working on a wide range of equipment such as ranging from wings to engines to tires and landing gear. Creepers have long been known and used by mechanics and others in a variety of work on hard-to-reach places. All creepers typically have rolling capability, for ease of movement from one location to another.

Creepers are very useful tools for mechanics, and are widely employed, especially for working under vehicles. They may be rolled into spaces which are hard to reach, and thereby allow work to be performed with far less strain than would be possible without the use of a creeper. Working under tall objects, such as airplane wings, may require long periods of time. Current creepers are not versatile, and therefore the mechanic finds himself in awkward positions, which will result in physical stress and strain, particularly to his back and neck.

As can be seen, there is a need for a versatile and adjustable mechanic creeper.

SUMMARY OF THE INVENTION

In one aspect of the present invention, a mechanic creeper comprises: a base comprising an upper surface, a lower surface, and a plurality of casters coupled to the lower surface; a height adjustment brace coupled to the upper surface of base; a table comprising an upper surface, a lower surface, a front end, a rear end, and sides, wherein the lower surface of the table is coupled to the height adjustment brace and the height adjustment brace is configured to raise and lower the table relative to the base; and a seat comprising a main frame and at least one cushion coupled to the main frame, wherein the seat is slidably coupled to the upper surface of the table by a track extending from the front end of the table to the rear end of the table.

These and other features, aspects and advantages of the present invention will become better understood with reference to the following drawings, description and claims.

BRIEF DESCRIPTION OF THE DRAWINGS

FIG. 4 is a section view of the present invention, taken along line 4-4 in

FIG. 1;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
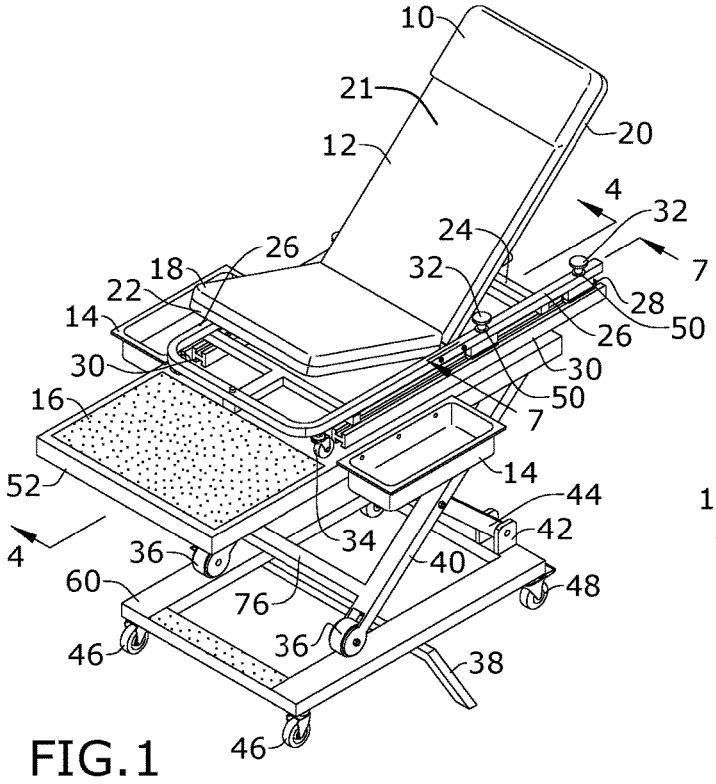
FIG. 1 is a perspective view of an embodiment of the present invention.
Figure 2:
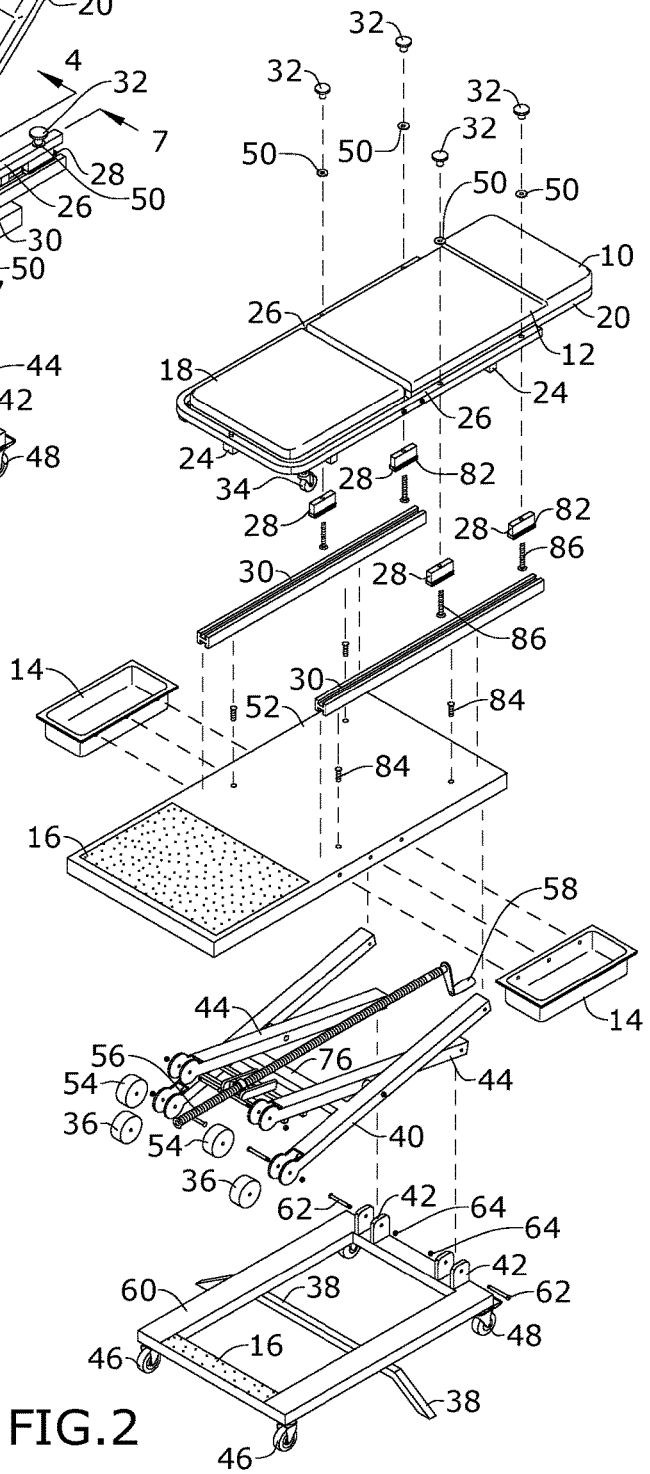
FIG. 2 is an exploded view of an embodiment of the present invention.
Figure 3:
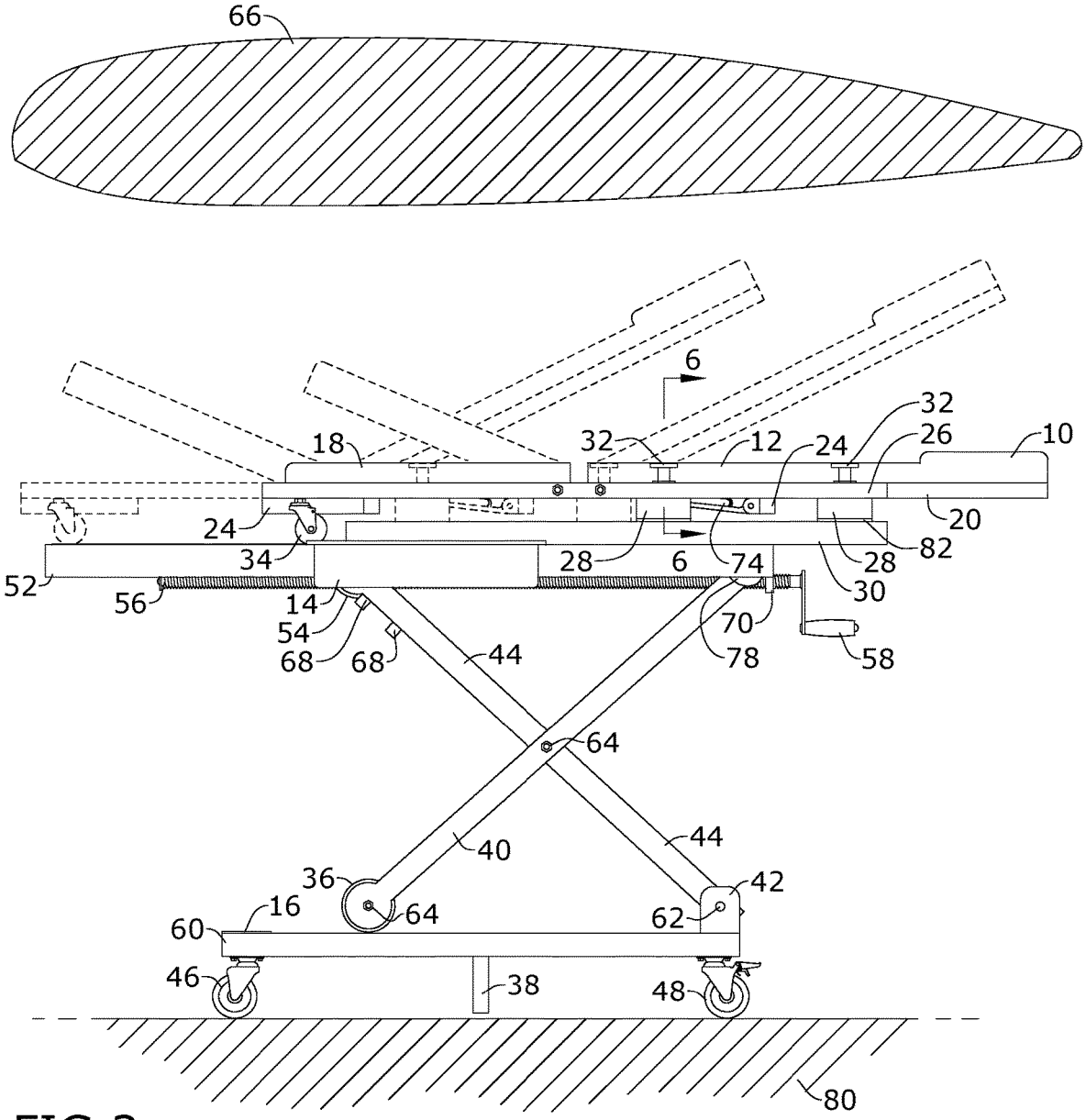
FIG. 3 is a side view of an embodiment of the present invention, shown in use.
Figure 4:
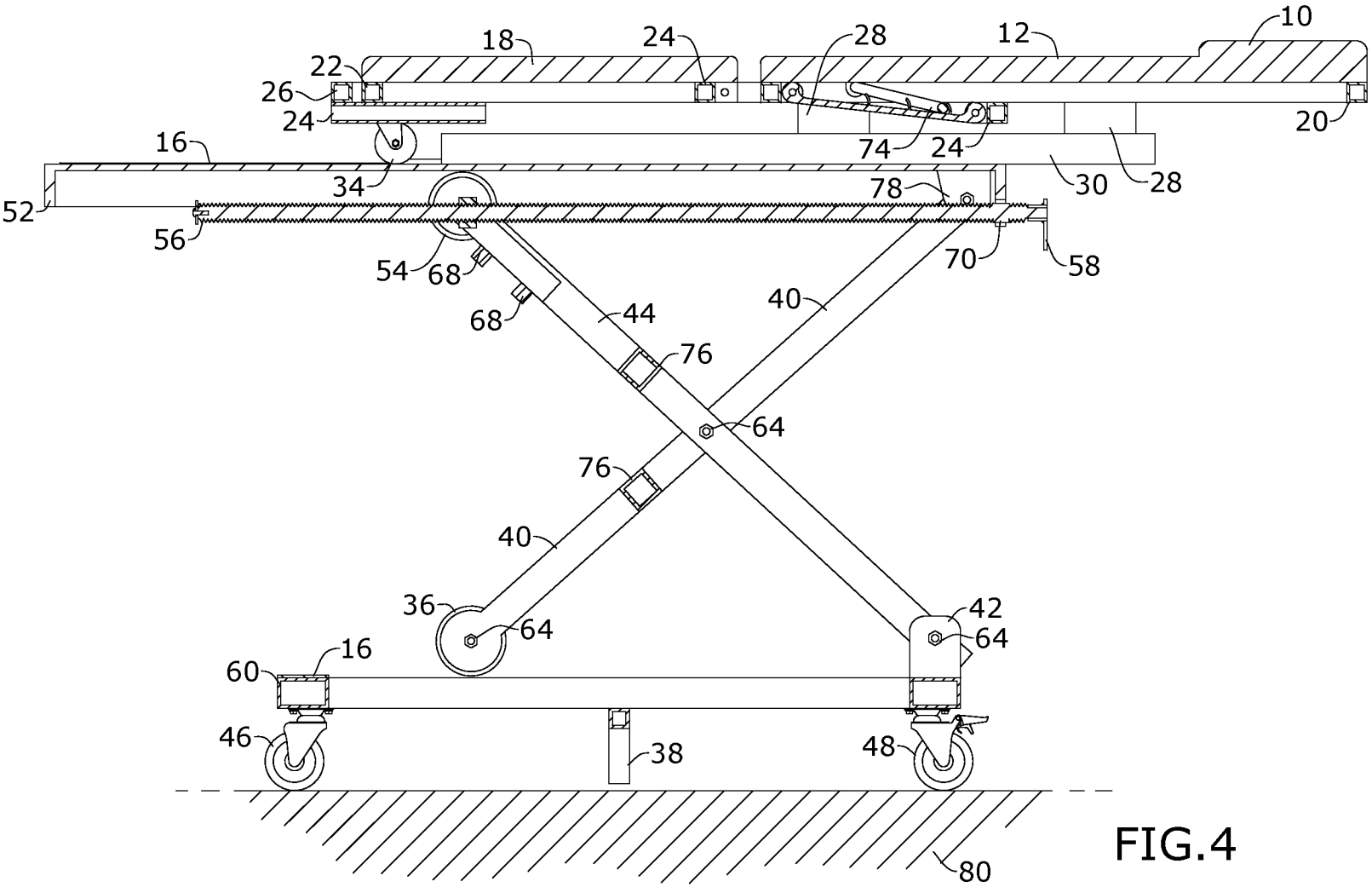
Figure 5:
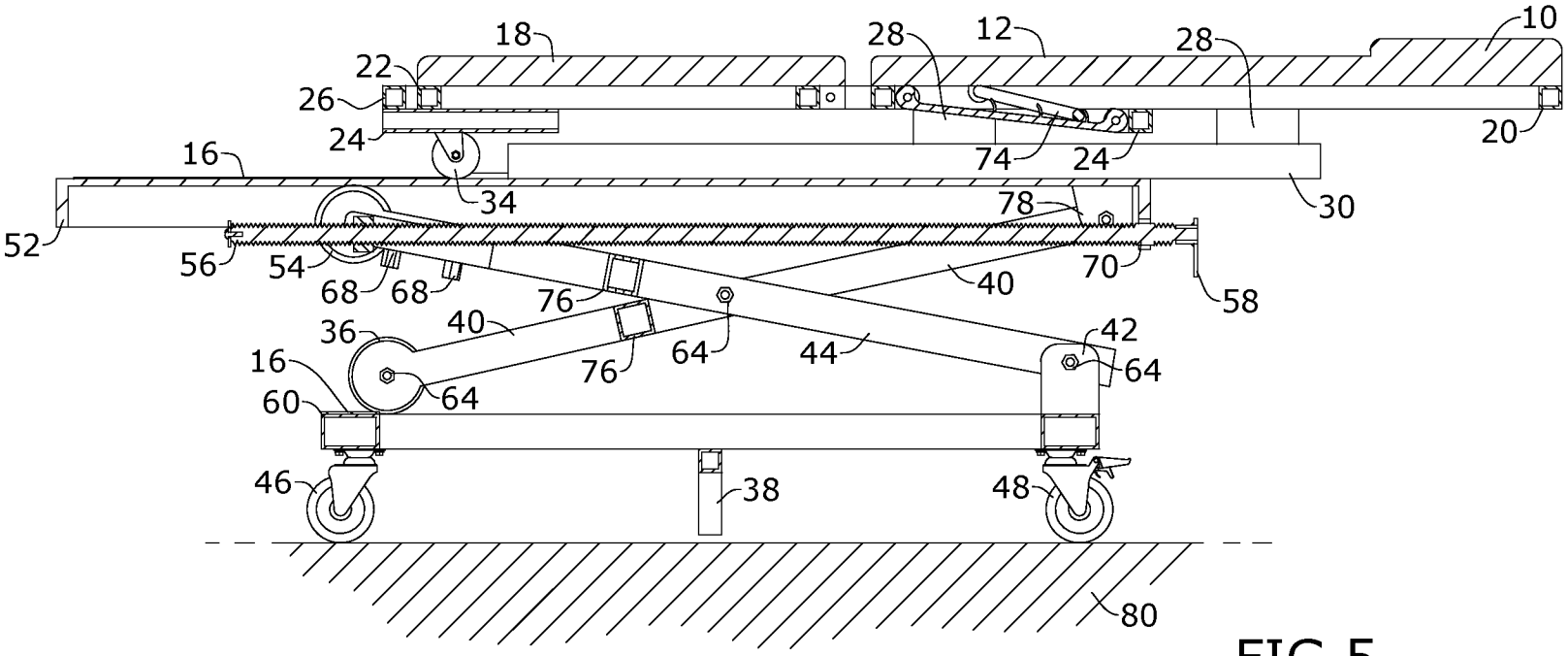
FIG. 5 is a section view of an embodiment of the present invention.
Figure 6:
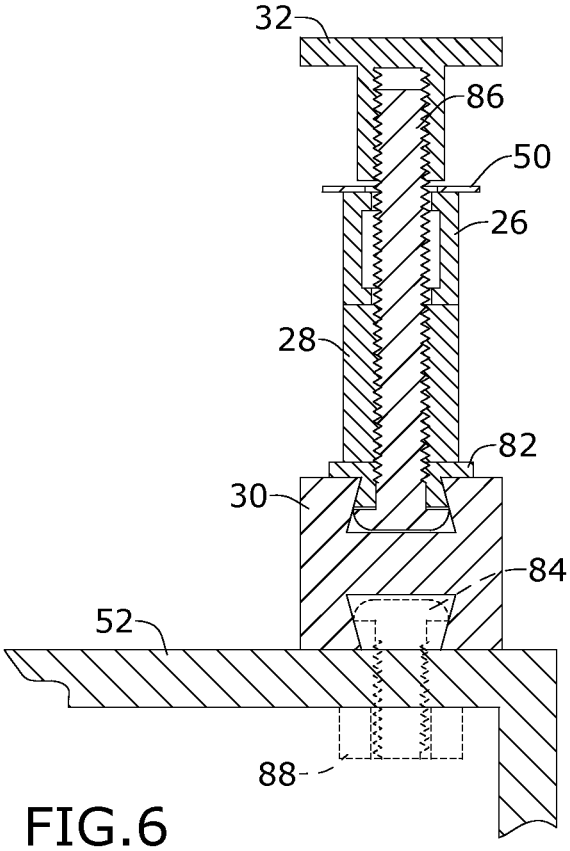
FIG. 6 is a detailed section view of the present invention, taken along line 6-6 in FIG. 3.
Figure 7:
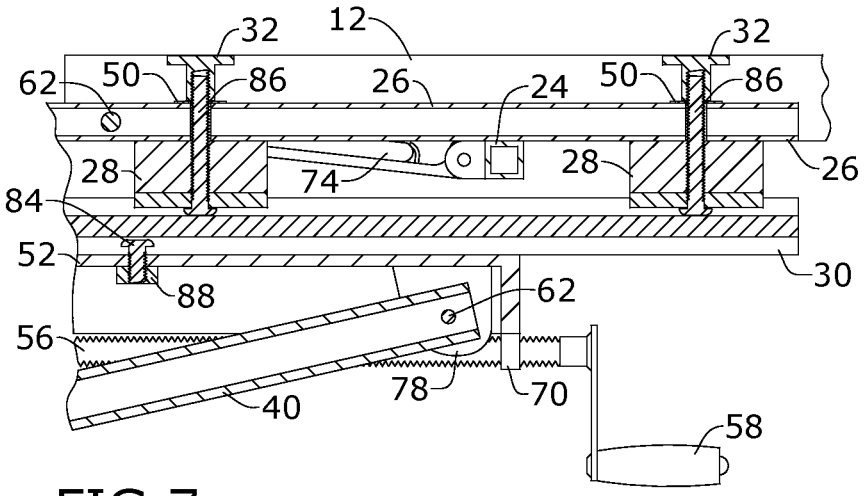
FIG. 7 is a detailed section view of the present invention, taken along line 7-7 in FIG. 1.

Referring to FIGS. 1 through 7, the present invention includes an adjustable mechanic creeper. The mechanic creeper includes a base 60 having an upper surface, a lower surface, and a plurality of casters 46, 48 coupled to the lower surface. A height adjustment brace 40, 44 is coupled to the upper surface of the base 60. A table 52 includes an upper surface, a lower surface, a front end, a rear end, and sides. The table 52 is coupled to the height adjustment brace 40, 44. The height adjustment brace 44 is configured to raise and lower the table 52 relative to the base 60. A seat 21 includes a main frame 26 and at least one cushion 10, 12, 18 coupled to the main frame 26. The seat 21 is slidably coupled to the upper surface of the table 52 by a track 30 extending from the front end of the table 52 to the rear end of the table 52.

In certain embodiments, a cross brace 24 may be coupled to the bottom front end of the main frame 26 to add support. The present invention may further include a back and head frame 20 pivotably coupled to the main frame 26. A head cushion 10 and a back cushion 12 are coupled to the back and head frame 20. Additionally, the present invention may include a seat frame 22 pivotably coupled to the main frame 26. A seat cushion 19 is coupled to the seat frame 22. The present invention further includes back adjustment bar 74 configured to pivot the back and head frame 20 and the seat frame 22 upwards, allowing a user to adjust from laying down flat to a reclined position.

The seat 21 may further include wheels 34 coupled to the bottom front of main frame 26. At least one slide 28, such as a plurality of slides 28 may be coupled to sides of the main frame 26. The slides 28 are disposed within the track 30. The slides 28 and the wheels 34 allow the seat 21 to slide forward and backward along the table 52. A clamp may lock the slides 28 to the track 30 and thereby lock the seat 21 into a fixed position relative to the table 52. In such embodiments, each of the slides 28 may include a lock spacer 82 disposed within the track 30. A lock bolt 86 may run through the lock spacer 82, the respective slide 28, and the main frame 26. A washer 50 may be disposed over the lock bolt 86 and above the main frame 26. A threaded knob 32 mechanically fastens to the end of the lock bolt 86. Rotating the knob 32 clockwise tightens the lock spacer 82 against the track 20 and fixes the seat 21 to the table 52. Rotating the knob 32 counter-clockwise loosens the lock spacer 82, allowing the slide 28 to slide along the track 30 so that a user may adjust their position.

The table 52 of the present invention may include tool bins 14 coupled to the sides. Additionally, a non-slip grip 16 may be adhered to the top surface at the front of table 52 where a user rests their feet. In certain embodiments, the track 30 may be coupled to the top surface at the rear of the table 52 by bolts 84 and nuts 88. Leg connecting brackets 78 may extend from the bottom surface at the rear of the table 52 to connect with the height adjusting brace 40, 44

The height adjusting brace 40, 44 may include a first pair of leg braces 40 and a second pair of leg braces 44. Wheels 36 may be coupled to the bottom ends of the first pair of leg braces 40 and top ends of the first pair of leg braces 40 are pivotably coupled to the leg connecting brackets 78 of the table 52 by nuts 64 and bolts 62. A cross brace 76 may connect the first pair of leg braces 40 together. Wheels 54 may be coupled to the top ends of the second pair of leg braces 44 and the bottom ends of the second pair of leg braces 44 may be pivotably coupled to leg connecting brackets 42 of the base 60 by nuts 64 and bolts 62. The height adjusting brace 40, 44 may further include a screw auger including a threaded rod 56 and a hand crank 58. The threaded rod 56 is threadably engaged within a threaded rod support 68 coupled to the second pair of leg braces 44 and the threaded rod 56 is supported by a rod support 70 coupled to the bottom surface of the table 52. The user may simply rotate the hand crank 58 to lift the table 52 and lower the table 52 relative to the base 60.

The base 60 of the present invention may include an anti-tip brace 38 coupled to the lower surface. The anti-tip brace 38 may include legs extending laterally from the lower surface of the base 60. The base 60 may further include a non-slip grip 16 adhered to the top surface, allowing a user to manipulate the base 60 with their feet. The base 60 further includes front wheels 46 and rear locking wheels 48. The leg connecting brackets 42 are coupled to the top surface at rear end of the base 60.

A method of using the present invention may include the following. Lay on the seat cushion 18, back cushion 12, and head cushion 10. Unlock the rear locking wheels 48 and roll the base 60 on a surface 80 to underneath an elevated mechanism in need of repair, such as a wing 66. Either the user or someone else may rotate the hand crank 58 to raise the table 52 relative to the base 60. The user may then adjust the seat 21 by raising and lowering the back and head frame 20 and the seat frame 22. Additionally, the user may slide the seat 21 back and forth on the table 52. The user may lock the seat 21 in place and begin working. The user may make additional adjustments to the mechanic creeper while working.

It should be understood, of course, that the foregoing relates to exemplary embodiments of the invention and that modifications may be made without departing from the spirit and scope of the invention as set forth in the following claims.

What is claimed is:

1. A mechanic creeper comprising:

a base comprising an upper surface, a lower surface, and a plurality of casters coupled to the lower surface;

a height adjustment brace coupled to the upper surface of base;

a table comprising an upper surface, a lower surface, a front end, a rear end, and sides, wherein the lower surface of the table is coupled to the height adjustment brace and the height adjustment brace is configured to raise and lower the table relative to the base; and a seat comprising a main frame and at least one cushion coupled to the main frame, wherein the seat is slidably coupled to the upper surface of the table by a track extending from the front end of the table to the rear end of the table.

2. The mechanic creeper of claim 1, wherein the seat further comprises a back and head frame pivotably coupled to the main frame and comprising a back cushion and a head cushion, and a seat frame pivotably coupled to the main frame and comprising a seat cushion.

3. The mechanic creeper of claim 2, wherein the seat further comprises a back adjustment bar configured to pivot the back and head frame and the seat frame upwards.

4. The mechanic creeper of claim 1, wherein the track is coupled to the upper surface of the table.

5. The mechanic creeper of claim 4, wherein the seat further comprises wheels coupled to a bottom frontward portion of the main frame and at least one slide coupled to the bottom rearward portion of the main frame, wherein the wheels roll on the upper surface of the table and the at least one slide is slidably disposed within the track.

6. The mechanic creeper of claim 5, further comprising clamps configured to lock the seat in a fixed position relative to the track.

7. The mechanic creeper of claim 1, wherein the table further comprises at least one tool bin coupled to one of the sides.

8. The mechanic creeper of claim 1, wherein the height adjustment brace comprises:

a first pair of leg braces comprising wheels coupled to bottom ends and top ends pivotably coupled to the lower surface of the table;

a second pair of leg braces comprising wheels coupled to top ends and bottom ends pivotably coupled to the base; and a screw auger comprising a threaded rod and a hand crank, wherein the threaded rod is threadably engaged within a threaded rod support coupled to the second pair of leg braces and the threaded rod is supported by a rod support coupled to the bottom surface of the table top.

9. The mechanic creeper of claim 1, wherein the table further comprises a non-slip grip adhered to the top surface.

10. The mechanic creeper of claim 1, wherein the base further comprises an anti-tip brace comprising legs extending laterally from the lower surface of the base.

* * * * *